United States Patent [19]

Le Mer

[11] Patent Number: 4,996,950

[45] Date of Patent: Mar. 5, 1991

[54] DOUBLE PIPES FOR MIXED BOILERS, TO THE METHODS OF MANUFACTURING SUCH PIPES AND TO THE CORRESPONDING BOILERS

[75] Inventor: Joseph Le Mer, St Thegonnec, France

[73] Assignee: Chaffoteaux et Maury, France

[21] Appl. No.: 504,859

[22] Filed: Apr. 5, 1990

[30] Foreign Application Priority Data

Apr. 7, 1989 [FR] France ..... 89 04609

[51] Int. Cl.[5] ..... F22B 15/00; F22B 37/10

[52] U.S. Cl. ..... 122/260; 122/367.1; 122/235.16; 165/140; 165/170; 237/19; 29/890.039

[58] Field of Search ..... 165/140, 170; 237/19; 122/367.1, 367.3, 235.16, 260, 261; 29/890.039

[56] References Cited

U.S. PATENT DOCUMENTS

| | | | |
|---|---|---|---|
| 1,823,919 | 9/1931 | Smith | 165/140 |
| 4,655,174 | 4/1987 | Fillios | 122/261 |

FOREIGN PATENT DOCUMENTS

| | | | |
|---|---|---|---|
| 22025 | 1/1981 | European Pat. Off. | 165/140 |
| 994946 | 6/1965 | United Kingdom | 165/140 |

*Primary Examiner*—Albert W. Davis, Jr.
*Attorney, Agent, or Firm*—Larson & Taylor

[57] ABSTRACT

A double pipe is disclosed for mixed boilers comprising rectilinear segments in which the two duct sections are juxtaposed laterally. Each section (A,B) is defined, on its side the furthest away from the other section, by a plate (1,7) whose two longitudinal borders (2,3,8,9) are curved and are welded against the longitudinal borders of an intermediate partition (4) and this intermediate partition has stamped bosses (5) whose tops (6) are in contact with said plates and are fixed thereto.

10 Claims, 1 Drawing Sheet

Figure 1:
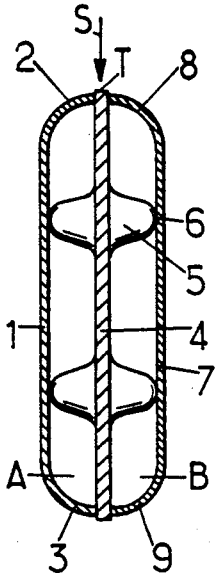

DOUBLE PIPES FOR MIXED BOILERS, TO THE METHODS OF MANUFACTURING SUCH PIPES AND TO THE CORRESPONDING BOILERS

The invention relates to mixed hot water boilers, namely boilers which heat water for supplying both a central heating circuit and a domestic or hot water supply circuit.

It relates more particularly, among such boilers, to those in which the heat exchanger is equipped with double pipes, namely having two metal ducts assigned respectively to the two independent water circuits, these pipes comprising rectilinear segments in which the two ducts are juxtaposed laterally, which segments are generally braced by parallel cooling fins brazed together and curved segments, generally in the form of a semicircle, connecting the rectilinear segments together and forming a coil therewith.

The invention also relates to the double pipes of said boilers and more particularly their rectilinear segments.

In known embodiments (see for example patent FR-1 332 607), the rectilinear segments of the kind in question are formed by two metal tubes welded laterally one against the other.

This construction has a number of drawbacks and in particular the following:

it is difficult to provide, inside each tube, rigid braces connecting the wall of this tube, which is attached side by side to the other tube, to the opposite wall, which braces are intended for preventing deformation of the tube during operation of the boiler following heat expansion and/or hydraulic thrusts due to the water flow, the double wall which is located in the middle of the pipe corresponds to a useless excess of metal, it is difficult to provide good mutual welding of the two components of said double wall.

The object of the invention is, among other things, to overcome these drawbacks.

For this, the rectilinear segments of the double pipes of the kind in question according to the invention, comprising two laterally juxtaposed metal duct sections, are essentially characterized in that one at least of these two sections is defined, on its side the furthest away from the other section, by a metal plate whose two longitudinal borders are curved and are welded against the longitudinal borders of an. intermediate metal partition also forming part of the segment considered and in that this intermediate partition has stamped bosses whose tops are in contact with the plate and are fixed thereto.

In some embodiments, recourse is further had to one and/or other of the following arrangements:

the two sections are defined outwardly by plates which are symmetrical with each other with respect to the mean plane of the intermediate partition, then flat, in a rectilinear segment according to the preceding paragraph, each longitudinal end of the intermediate partition is deformed transversely in the form of an S so as to have two longitudinal half-cups open outwardly, separated from each other by a non deformed bridge of the partition and the bottoms of which are juxtaposed jointingly against the facing plates, and each longitudinal plate end is itself deformed in the middle by a longitudinal outwardly open half-cup whose bottom is juxtaposed jointingly against the bridge of the intermediate partition, which defines two necks whose sections are preferably different, these necks being joined to independent external pipe sections, the curved borders of the plates are oriented perpendicularly to the borders of the intermediate partition to which they are welded and the end edges of the first borders are juxtaposed against the lateral faces of the second borders, the bosses projecting respectively from the two faces of the intermediate partition are formed so that the disturbances which they create in the water streams flowing through the two duct sections forming the same rectilinear segment comprising this partition are different, in a rectilinear segment according to the preceding paragraph, the bosses projecting respectively from the two faces of the intermediate partition are all identical, but their numbers are different, the intermediate partition is formed by a sheet thicker that the sheets forming the two plates with curved borders welded to this partition.

The invention also relates to heat exchangers comprising pipes such as defined above as well as the boilers equipped with such exchangers.

It also relates to the methods of manufacturing such pipes, said methods being essentially characterized in that, when the elements to be welded together are juxtaposed, a border of one of such elements is caused to project slightly beyond each zone to be welded so that the projecting border forms filler metal for welding, which is obtained by causing said zone to travel in front of a welding head.

Apart from these main arrangements, the invention comprises certain other arrangements which are preferably used at the same time and which will be more explicitly discussed hereafter.

In what follows, several embodiments of the invention will be described with reference to the accompanying drawings in a way which is of course in no wise limitative.

Figure 2:
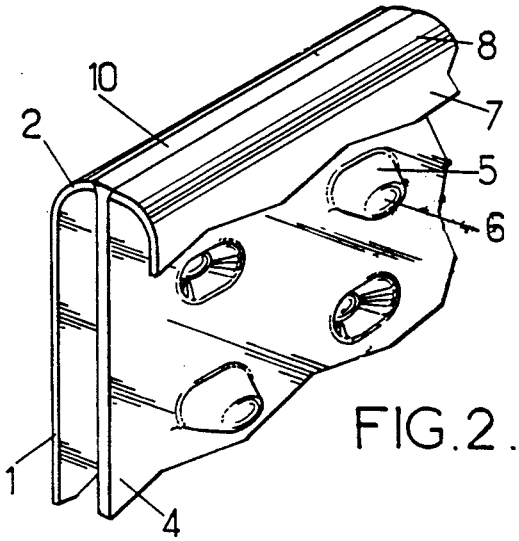
Figure 3:
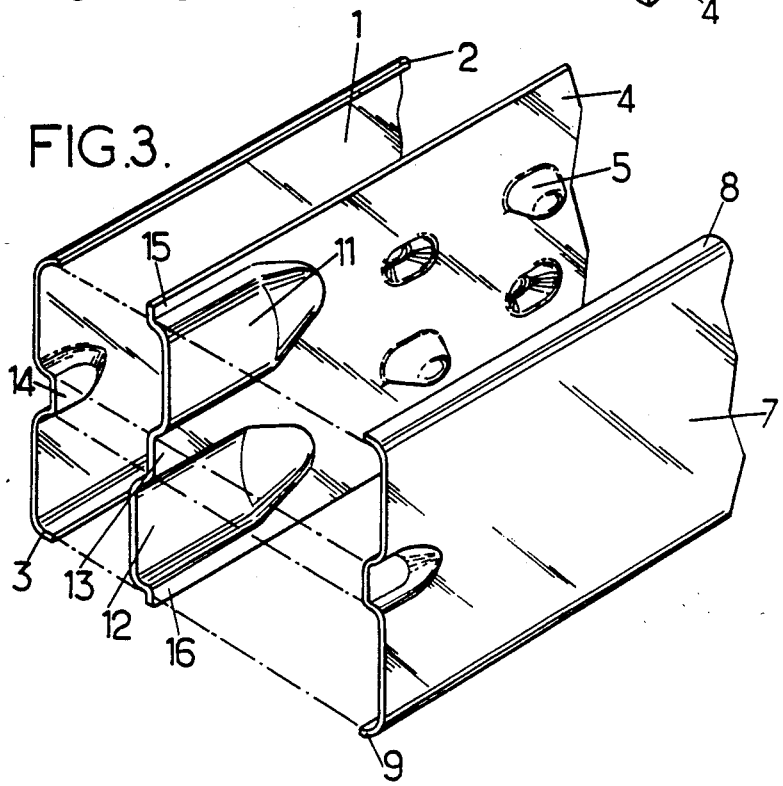
Figure 4:
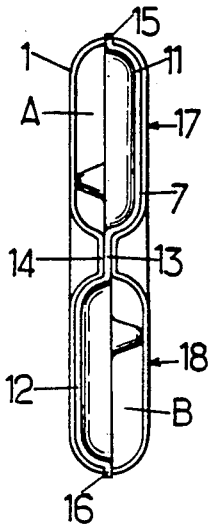
Figure 5:
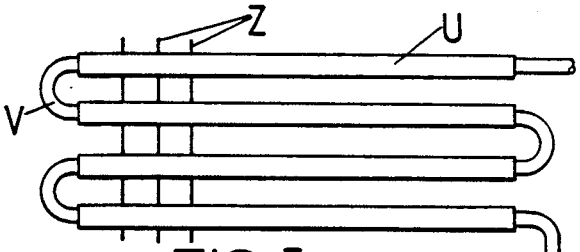
Figure 6:
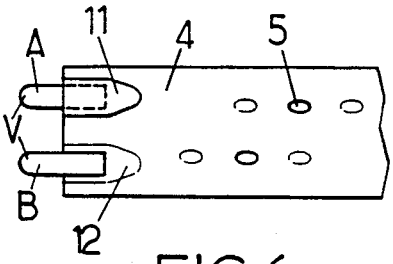

FIG. 1, of these drawings, shows in cross section a double pipe segment constructed in accordance with the invention, FIG. 2 shows this same segment in a perspective view, with portions cut away, FIGS. 3 and 4 show respectively in an exploded perspective view and in an end view a longitudinal end of said segment, FIG. 5 shows in a top view a boiler heating element constructed using a double pipe according to the invention, and FIG. 6 shows in a side view, after removal of a plate, a piece of another double pipe also in accordance with the invention.

In each case, in a way known per se:

the double pipe considered comprises a first duct A for the flow of central heating water heated by a mixed boiler, and a second duct B for the flow of domestic hot water heated by said boiler, this double pipe comprises rectilinear segments U (FIG. 5) joined together by curved segments V, with which they form a coil, said rectilinear segments being braced by parallel metal fins Z brazed thereon, and in said rectilinear segments, the two duct sections A and B forming the double pipe are disposed laterally side by side.

In each case again, but here according to the invention, one at least of the two sections, for example here section A, is defined on its side the furthest away from the other section B by a metal plate 1 whose two longitudinal borders 2, 3 are curved and welded to the longitudinal borders of an intermediate metal partition 4, and this intermediate partition 4 has stamped bosses or studs 5 whose tops 6 are in contact with plate 1 and are secured thereto.

In the preferred embodiment illustrated in FIGS. 1 to 4, the two sections A and B are defined externally by partitions which are symmetrical with each other with respect to the mean plane of the intermediate partition 4, then flat.

The second section B is therefore defined, on its side the furthest away from partition 4, by a metal plate 7 whose two longitudinal borders 8 and 9 are curved and are welded to partition 4.

Bosses 5 are then stamped in the partition 4 so as to project alternately from the two faces of this partition, successively in the direction of the two plates.

As can be seen in the drawings, bosses 5 are in particular aligned in two rows parallel to the longitudinal direction of the pipe.

The height of each boss is chosen equal to the inner thickness of sections A and B, reckoned perpendicularly to partition 4 so that, during manufacture of said sections, the tops 6 of these bosses come into contact with the facing plates 1 and 7.

Partition 4 may be formed by a metal sheet or strip thicker than that forming the two plates 1 and 7, these thicknesses being for example 1.2 mm for the partition and 0.8 mm for the plates.

But, in advantageous embodiments, plates 1 and 7 and partition 4 are formed by strips stamped from the same metal sheet, particularly copper, which simplifies manufacture.

For welding the two plates 1 and 7 on partition 4, the filler metal required for each weld may advantageously be formed by a lateral edge T of said partition 4, which is caused to project slightly with respect to the edges of the curved borders 2, 3, 8, 9 to be welded, as can be seen in FIG. 1.

The weld is then made by placing a welding head, shown schematically by the arrow S in FIG. 1, facing said projecting edge T and causing edge T to travel longitudinally in front of the head S or conversely.

The molten metal which results from heating the edge is mixed with the molten metal from the curved adjacent borders so as to form, after cooling, a regular and sealed welding bead 10 (FIG. 2).

As can be clearly seen in the drawings, the curves of borders 2, 3, 8, 9 advantageously have a profile in the form of a quarter of a circle so that the edges of these borders are oriented perpendicularly to the mean plane of the partition 4 and are juxtaposed against the lateral marginal faces of the borders of this partition 4.

After welding, the external face of each welded zone has a smooth and continuous semi-cylindrical shape, as can be clearly seen in FIG. 2.

The tops 6 of bosses 5 are fixed by brazing against the faces of plates 1 and 7 which are applied thereagainst.

For this, care should be taken to coat the tops of the bosses with a layer of brazing material before welding the plates against the partition and then the whole is heated to a sufficiently high temperature to cause said material to melt at the level of tops 6.

As can be seen in the drawings, each rectilinear segment formed of two sections A and B fastened side by side is in short defined by two parallel flat walls joined together by two curved portions having a semi-circular section: the cross section of this segment can in short be inscribed in an elongate rectangle whose width is generally between 8 and 20 mm, preferably about 10 mm and whose length is generally between 40 and 100 mm, being generally about 60 mm.

Bosses 5 are advantageously in the form of rounded nipples whose base is oval and elongate in the longitudinal direction of the pipe, the large axis of the oval being about 8 mm and its small axis about 4 mm and the longitudinal spacing between the successive bosses being about 8 mm.

For ready mutual connection of the above defined rectilinear segments U using intermediate curved segments V, the longitudinal ends of these rectilinear segments are advantageously formed in the following way (see FIGS. 3 and 4).

Each longitudinal end of the intermediate partition 4 is deformed transversely in the form of an S so as to have two longitudinally half-cups 11, 12 open longitudinally outwardly and projecting respectively from the two opposite faces of the partition.

These two half-cups are separated from each other by a non deformed bridge 13 of said partition.

The depth of each half-cup is equal to the thickness of a section A, B so that its bottom is juxtaposed jointingly against the facing plate 1, 7. Each half-cup 11, 12 is separated from the adjacent longitudinal border of partition 4 by a flat narrow and undeformed margin 15, 16 of this partition.

Furthermore, the median zone of each longitudinal end of the plate is deformed so as to form a longitudinal half-cup 14, smaller than the preceding ones, which is also open longitudinally outwardly and whose depth is such that its bottom is juxtaposed jointingly against bridge 13.

The wall portions in mutual contact are advantageously brazed together.

Under these conditions, two cylindrical end necks 17, 18 are formed at each longitudinal end of each rectilinear segment U, each neck serving only one of the two sections A and B of this segment.

Thus, neck 17 serving only the section A (FIGS. 3 and 4) is defined by the half-cup 11 and the facing portion of plate 1, this neck being closed, on the side of the longitudinal border of the segment considered, by welding curved border 2 against margin 15 and, at about the middle of the height of said segment, by application of the bottom of the corresponding half-cup 14 against the facing bridge 13.

The production of necks 17 and 18 follows automatically from manufacture of the corresponding rectilinear pipe segment, which is extremely simple since it is sufficient:

to prepare parts 1, 4 and 7 by stamping rectangular metal strips so as to form in these strips the different above described projections (bosses 5 and half-cups 11, 12 and 14), to juxtaposed these three parts with possible interpositioning of brazing material, to join them together by the above described welding beads 10, and to heat the whole until an intimate connection is obtained between the different jointingly juxtaposed surfaces.

It is then easy to connect the cylindrical necks 17, 18 of the successive rectilinear segments U together by means of segments V curved in the form of a half circle and having profiles complementary to those of said necks, the ends of these curved segments being fitted jointingly into said necks as can be seen in FIG. 5.

In the embodiments which have been illustrated in FIGS. 2 and 3, the numbers of bosses 5 projecting respectively from the two faces of partition 4 are identical so that the disturbance caused to the streams of water flowing respectively through the two sections A and B is the same.

In a variant, which may be advantageous in some cases and which has been shown schematically in FIG. 6, the numbers of such bosses projecting respectively on each side of partition 4 are given different values, this number being higher for section A in which the central heating water flows than in section B through which the domestic hot water flows.

The Applicant has in fact observed that the risk of scaling is higher in the second circuit than in the first since, in the first case, the heating water flows through a closed circuit and therefore carries a proportion of mineral charges which becomes smaller and smaller as its flows.

Since the degree of scaling of a pipe is all the higher the more the water flowing through this pipe is disturbed and since such disturbance is itself all the higher the higher the number of bosses projecting in the pipe considered, it is advantageous here to give this number a higher value in the heating section A than in the domestic hot water section B.

In the example illustrated in FIG. 6, the number of bosses projecting in section A, which bosses are shown in phantom outline, is equal to twice the number of bosses projecting in section B and shown with a thick line.

Since pressure losses present more drawbacks in the heating circuit—which generally comprises a pump—than in the domestic circuit, it is advantageous to reduce such pressure losses as much as possible in the first circuit.

For this, in a preferred embodiment, the above necks 17 assigned to the heating circuit are given a larger section than the necks 18 assigned to the domestic hot water circuit.

Following which and whatever the embodiment adopted, pipes and heat exchangers are finally obtained whose construction follows sufficiently from what has gone before.

These pipes and exchangers have numerous advantages with respect to those known heretofore and in particular the following:

the pipes considered are indeformable because of the presence of spacing bosses therein, the heat exchanges between the two ducts are excellent considering in particular the heat conductivity provided by the bosses themselves, the arrangement proposed provides a saving of metal with respect to those using tubes fixed one against the other and leading to the formation of double walls, manufacture is very simple since the stamping and juxtaposing operations are themselves very simple and since the welding operations are here easy to carry out and are localized along beads of small thickness.

As is evident and as it follows moreover from what has gone before, the invention is in no wise limited to its modes of applications and embodiments which have been more specifically considered; it embraces, on the contrary, all variants thereof.

What is claimed:

1. Double pipe rectilinear segment for mixed boilers comprising two laterally juxtaposed metal duct sections (A,B), characterized in that one at least of these two sections (A) is defined, on its side the furthest away from the other section (B), by a metal plate (1) whose two longitudinal borders (2,3) are curved and are welded against the longitudinal borders of an intermediate metal partition (4) also forming part of the segment considered and in that this intermediate partition has stamped bosses (5) whose tops (6) are in contact with the plate and are fixed thereto.

2. Pipe segment according to claim 1, characterized in that the two sections (A,B) are defined outwardly by plates (1,7) which are symmetrical with each other with respect to the mean plane of the intermediate partition (4), then flat.

3. Pipe segment according to claim 2, characterized in that each longitudinal end of the intermediate partition (4) is deformed transversely in the form of an S so as to have two longitudinal half-cups (11,12) open outwardly, separated from each other by a non deformed bridge (13) of the partition and the bottoms of which are juxtaposed jointingly against the facing plates (1,7), and in that each longitudinal plate end (1,7) is itself deformed in the middle by a longitudinal outwardly open half-cup (14) whose bottom is juxtaposed jointingly against the bridge (13) of the intermediate partition (4), which defines two necks (17,18).

4. Pipe segment according to claim 3, characterized in that one of the necks (17) has a larger section than the other (18).

5. Double pipe for mixed boilers, characterized in that is is formed of rectilinear segments (U) according to claim 3 connected together by curved tubular segments (V), particularly in the form of a semi-circle, fitted jointingly in the necks (17,18) of said rectilinear segments.

6. Pipe segment according to claim 1, characterized in that the curved borders (2,3,8,9) of the plates (1,7) are oriented perpendicularly to the borders of the intermediate partition (4) to which they are welded and in that the end edges of the first borders are juxtaposed against the lateral faces of the second borders.

7. Pipe segment according to claim 1, characterized in that the bosses (5) projecting respectively from the two faces of the intermediate partition (4) are formed so that the disturbances which they create in the water streams flowing through the two duct sections (A,B) forming the segment are different.

8. Pipe segment according to claim 7, characterized in that the bosses (5) projecting respectively from the two faces of the intermediate partition (4) are all identical, but their numbers are different.

9. Pipe segment according to claim 1, characterized in that the intermediate partition (4) is formed by a sheet thicker than the sheets forming the two plates (1,7) with curved borders welded to this partition.

10. Method for manufacturing a rectilinear pipe segment according to claim 1, characterized in that, when the elements to be welded (1,4,7) are juxtaposed one against the other, the border of one of such elements is caused to project slightly in each zone to be welded so that the projecting border (T) forms a filler metal for welding, which is obtained by causing said zone to travel past a welding head (S).

* * * * *